United States Patent [19]

Johnsen

[11] 4,116,470

[45] Sep. 26, 1978

[54] MEDICAL INFORMATION FORM FOR PLURALITY OF INDIVIDUAL REPORTS

[76] Inventor: Edward L. Johnsen, 12 Fox Meadow Ln., Wayland, Mass. 01778

[21] Appl. No.: 767,945

[22] Filed: Jan. 31, 1977

Related U.S. Application Data

[60] Continuation of Ser. No. 613,546, Sep. 15, 1975, abandoned, which is a division of Ser. No. 382,162, Jul. 24, 1973, Pat. No. 3,945,879.

[51] Int. Cl.[2] ..... B42D 11/00; G09F 1/10

[52] U.S. Cl. ..... 283/66 A; 40/158 R

[58] Field of Search ..... 283/66; 40/102, 125 A, 40/104.18; 401/158 R

[56] References Cited

U.S. PATENT DOCUMENTS

| | | | |
|---|---|---|---|
| 3,669,555 | 6/1972 | Holes et al. | 40/104.18 X |
| 3,720,130 | 3/1973 | Holson | 40/104.18 |
| 3,740,879 | 6/1973 | Patterson | 40/102 |

*Primary Examiner*—Stephen C. Pellegrino
*Attorney, Agent, or Firm*—J. Warren Kinney, Jr.

[57] ABSTRACT

A base or carrier sheet is selectively coated with pressure sensitive adhesive which is concealed by a protective, removable release sheet. The release sheet is subdivided into a plurality of interconnected, independently removable panels, each of which conceals an area of the base or carrier sheet and a portion of the adhesive pattern which is to be occupied by a single report.

1 Claim, 22 Drawing Figures

10
11
12
14
16
18
20
22
24
26
27
28
30
32
33
33a
33b
34
36
37
38
40
42
43
44
46
48
49
4
5

MEDICAL INFORMATION FORM FOR PLURALITY OF INDIVIDUAL REPORTS

This is a continuation of application Ser. No. 613,546 filed Sept. 15, 1975, now abandoned; which is a division of application Ser. No. 382,162 filed July 24, 1973, now U.S. Pat. No. 3,945,879.

BACKGROUND OF THE INVENTION

The present invention is directed to business forms, particularly to an endless multi-layer composite for subsequent processing and to the articles producible therefrom. The invention covers both the method of producing the endless composite and and to the resulting articles, per se.

In the past, a variety of multi-layer and multi-ply articles have been developed and utilized. Common disadvantages have been encountered when manufacturing each of these several articles. Two such articles are, for example, chance or lottery tickets wherein original indicia is to be applied to a portion thereof and concealed from view for later selective exposure, and filing devices wherein a mounting board or carrier sheet containing a pressure sensitive adhesive is utilized for assembly and filing of various documents.

While these articles vary greatly with respect to use and format, each presents similar manufacturing problems. Neither of the articles has heretofore been producible from a single, endless web, permitting processing and manufacture from a continuous automated process while meeting all critical requirements of each final article form.

This single disadvantage has generated a variety of solutions, each limited to a particular, narrowly construed article form. For example, where articles such as lottery or change tickets or the like require a high degree of secrecy, it is desirable that the concealed indicia be originally applied to the inner surface of the ticket and concealed for later selective exposure. No system previously disclosed permits the original application of concealed indicia with the required degree of secrecy, while permitting production in a continuous automated process. Two ticket formats have been devised, depending on the intended usage, each having limitations preventing their wide-spread acceptance. The first ticket format allows concealment of original indicia and maintains an acceptable degree of secrecy, for example, any of the tickets disclosed in each of U.S. Pat. Nos. 1,980,004; 2,108,749; and 2,180,808. In each of these patents, the indicia to be concealed is originally applied, and then concealed by placing a panel in overlying relationship therewith, the panel either partially or completely removable to later selectively expose the indicia. However, none of the patents in this group discloses nor suggests an article producible by mass production techniques while retaining or achieving the desired degree of secrecy.

The second ticket format permits mass production, however it is not tamper-proof and not acceptable for lottery games or similar gaming devices. An example of a ticket of this format is disclosed in U.S. Pat. No. 2,023,829. As described therein, the indicia is only partly concealed and may be exposed at will, only minimal secrecy being maintained. The ticket of Pat. No. 2,023,829 is of two-ply construction, produced from a blank containing a center fold line, the fold line defining two hinged panels. The blank is further separated by cross weakened lines. One panel of the blank contains an adhesive substance extending along the outer edge, each section of said panel adapted to receive indicia to be later concealed by folding the second panel thereupon along the center fold line. The second panel contains a hinged flap, corresponding to the location of each indicia, for later selective exposure. As disclosed, the final ticket is not designed nor is it adapted to maintain a high degree of secrecy with respect to the nature of the concealed indicia. The flap may be simply lifted to expose the indicia, and the end portions of each ticket are not sealed.

An article having similar production disadvantages, though different in form is a filing carrier sheet as disclosed in U.S. Pat. Nos. 3,043,734 and 3,740,879. Each of these patents discloses a filing device for assembling papers, such as medical records, in a shingled relationship by providing a carrier sheet having a pressure-sensitive adhesive supplied thereto for attaching various documents. The carrier sheet of U.S. Pat. No. 3,043,734 includes a wide band of adhesive covered with a protectiive release sheet, the release sheet being cut into transverse strips, each strip being selectively removable to expose a portion of the adhesive. The carrier sheet of U.S. Pat. No. 3,740,879 includes a longitudinal strip of adhesive extending the length of one marginal edge, a release sheet sectioned into independently removable portions covering the adhesive. Opposite the adhesive strip and adjacent another marginal edge of the carrier sheet is a series of adhesive spots also covered with removable release sheet. By removing one section of the release sheet from the adhesive strip and the release sheet covering the corresponding adhesive spot, documents may be attached to the carrier sheet in a manner similar to that of U.S. Pat. No. 3,043,734.

While U.S. Pat. No. 3,043,734 suggests the manner of making the article disclosed therein, neither patent discloses nor suggests the manufacture of carrier sheets from an endless composite web in a continuous, automated process.

Thus, each of the article forms herein described have singular disadvantages in that neither is producible in mass quantities from a continuous process while meeting certain critical requirements.

The present invention provides a single, unique solution to each of the problems in manufacturing the various article formats by providing an endless multi-layer composite adapted to be further processed to generate either lottery tickets containing originally applied concealed indicia, or filing carrier sheets for use in attaching documents in a predetermined, accessible order.

The present invention discloses a unique, multi-layer composite from which a variety of articles may be produced. The composite consists of three basic layers: an endless web of base material, a layer of pressure sensitive adhesive selectively applied to the base material, and an endless web of readily removable protective release material placed in overlying relationship therewith. By selectively applying adhesive and performing certain preliminary manufacturing steps on the base material and/or the release material, the present invention provides a suitable multi-layer composite for continuously producing the articles of either of the described formats in mass quantities.

Therefore, the present invention not only provides a unique multi-layer material composite, but also a variety of unique articles of independent and distinct format, each of the articles adapted to similar mass production techniques and producible from the unique, continuous multi-layer composite of the present invention as well as the method for producing each.

Figures 1, 2, 3A, 3B:
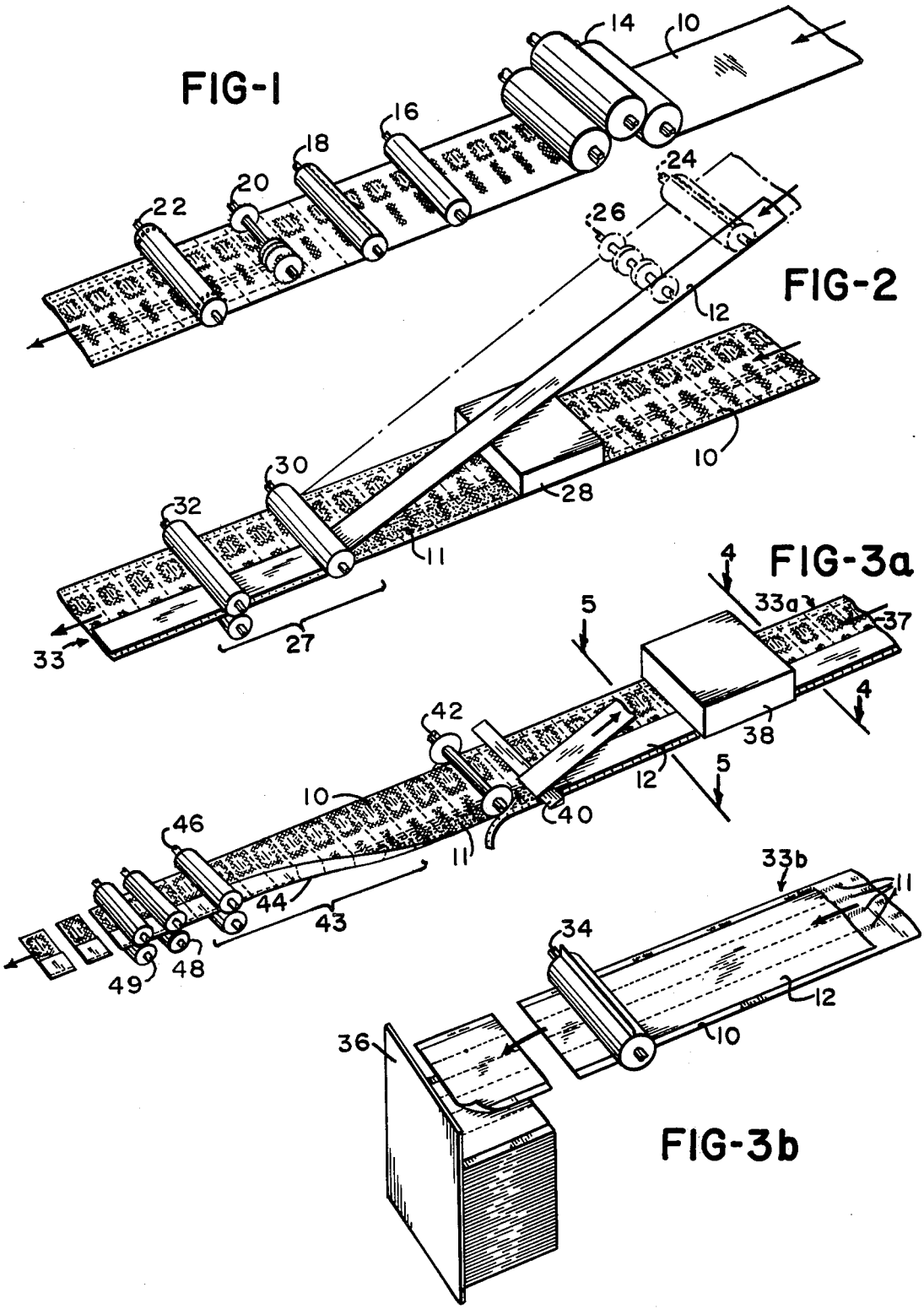
FIGS. 1 and 2 are diagrammatic illustrations of the preliminary processing steps in the manufacture of articles which embody the teachings of the present invention.

FIG. *3a* diagrammatically illustrates a method for producing a first article from the multi-layer composite of FIG. 2.

FIG. *3b* diagrammatically illustrates a method for producing a second article from the multi-layer composite of FIG. 2.

Figure 4:
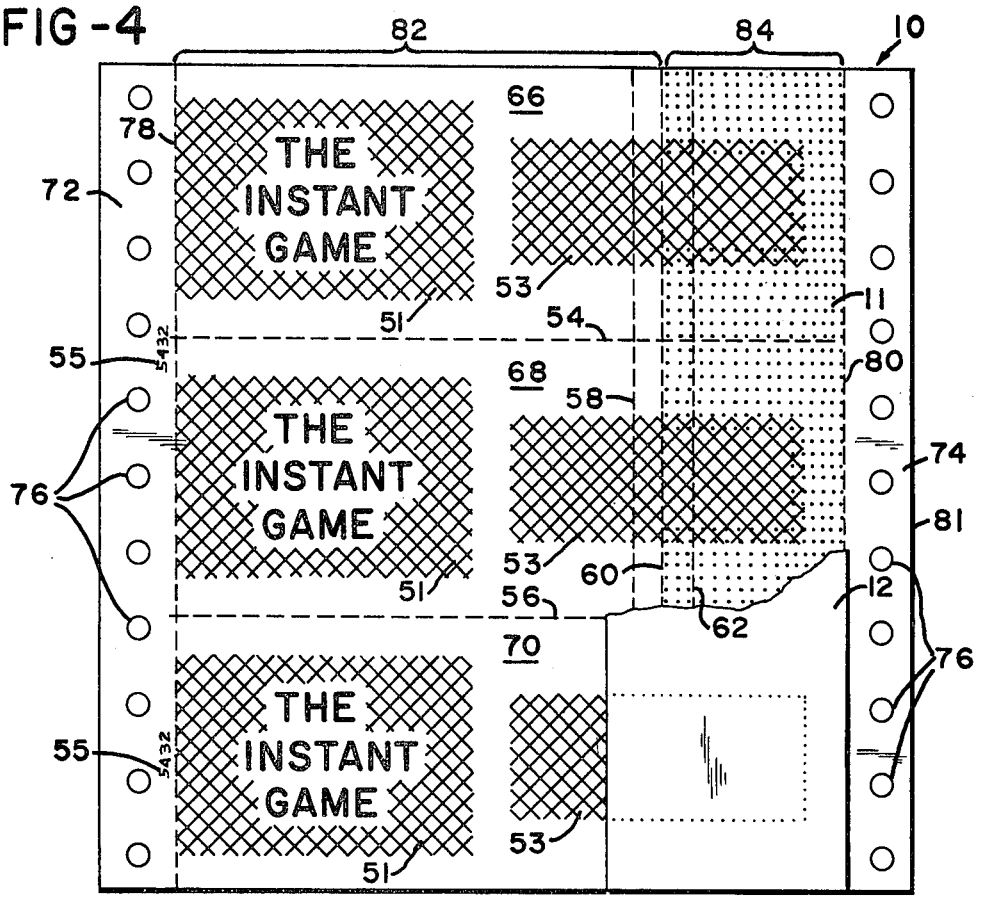

FIG. 4 is a plan view of a multi-layer composite ready for storage or further processing with components thereof broken away for clarity of detail and understanding and as shown at 4—4 of FIG. *3a*.

Figure 5:
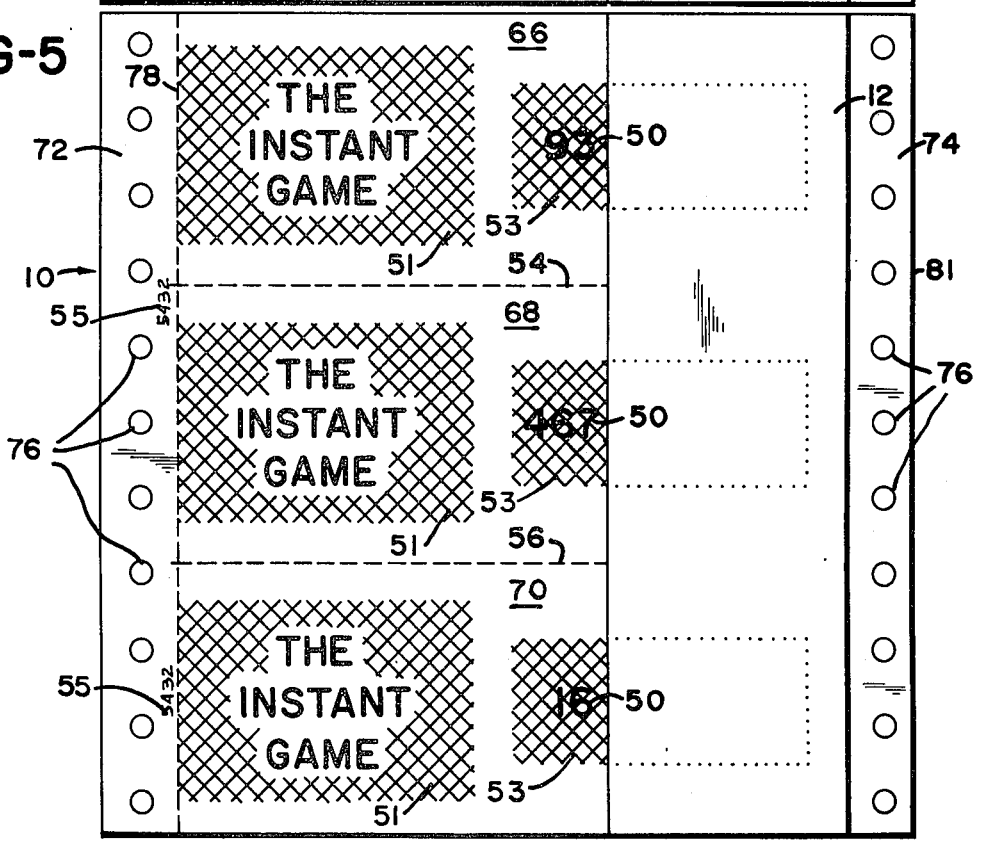

FIG. 5 is a view similar to FIG. 4, illustrating the multi-layer composite with original indicia applied, as shown at 5—5 of FIG. *3a*.

Figure 6:
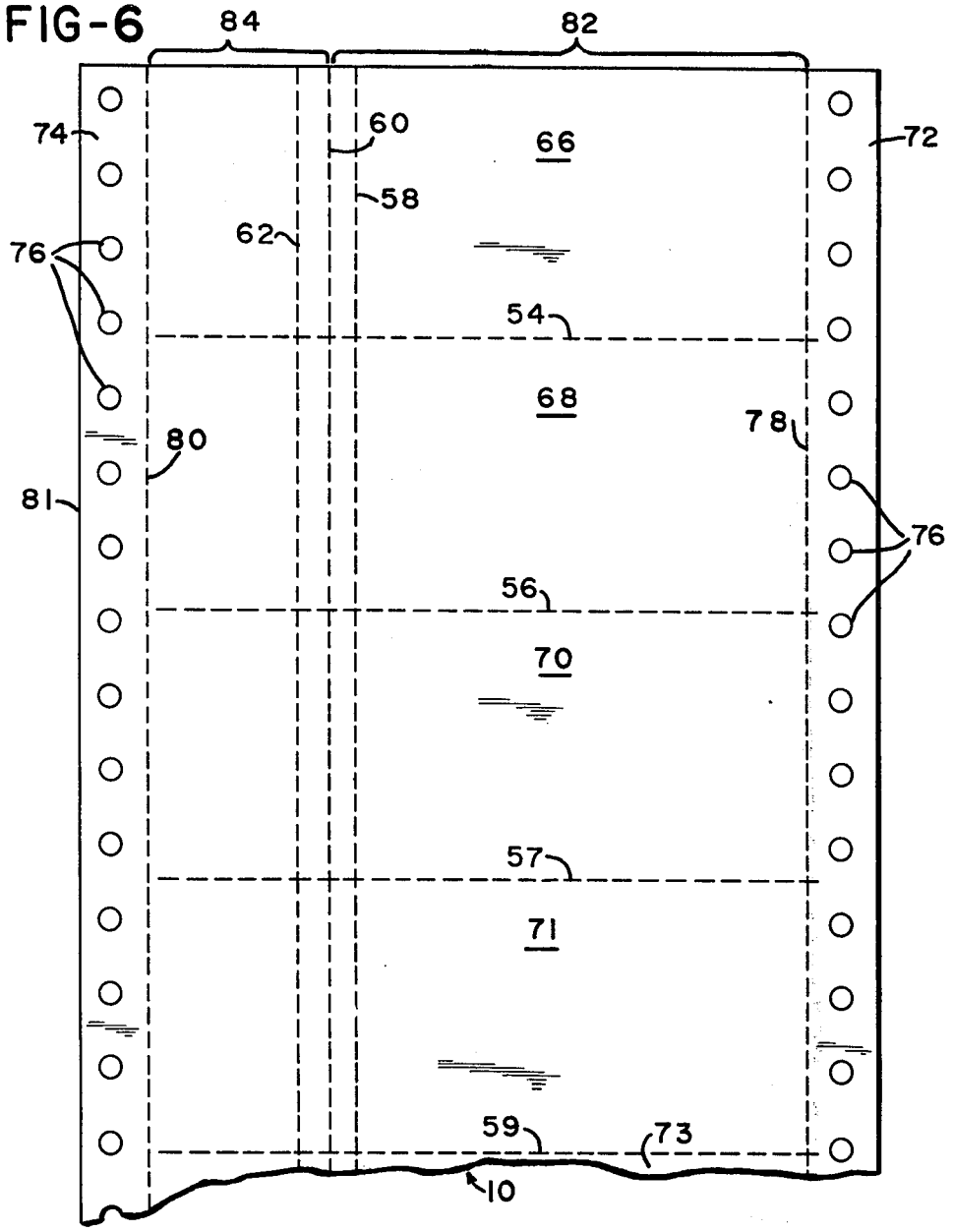

FIG. 6 is a plan view of the underside of the multi-layer composite of FIG. 4.

Figure 7:
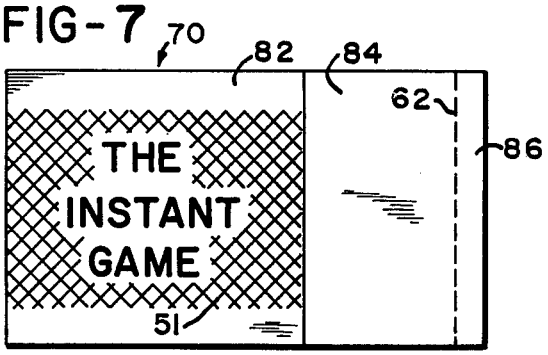

FIG. 7 is a plan view of a first article produced from the multi-layer composite of FIG. 2.

Figure 8:
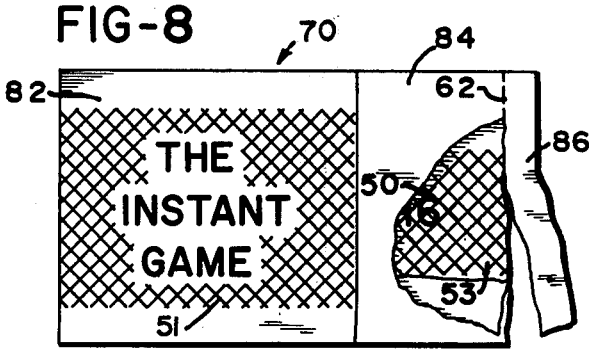

FIG. 8 is a view similar to FIG. 7, illustrating the manner in which the concealed indicia is exposed.

Figure 9:
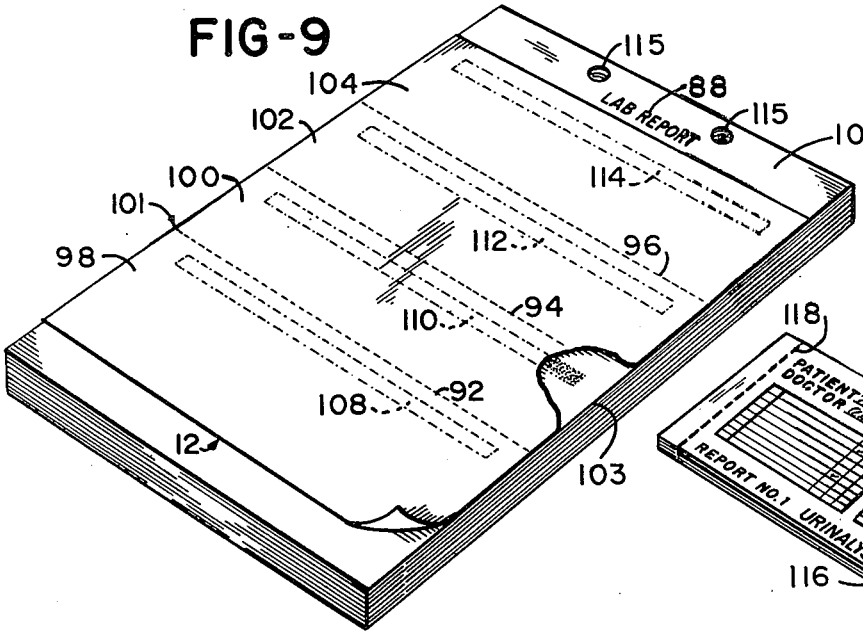

FIG. 9 is a perspective view of a second article produced from the multi-layer composite of FIG. 2.

Figure 10:
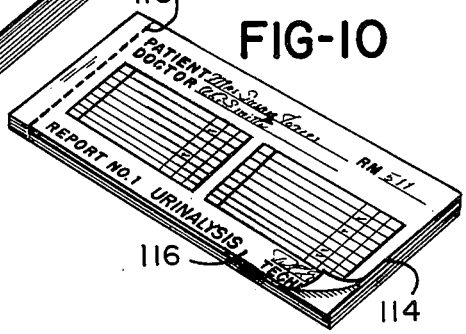
Figure 11:
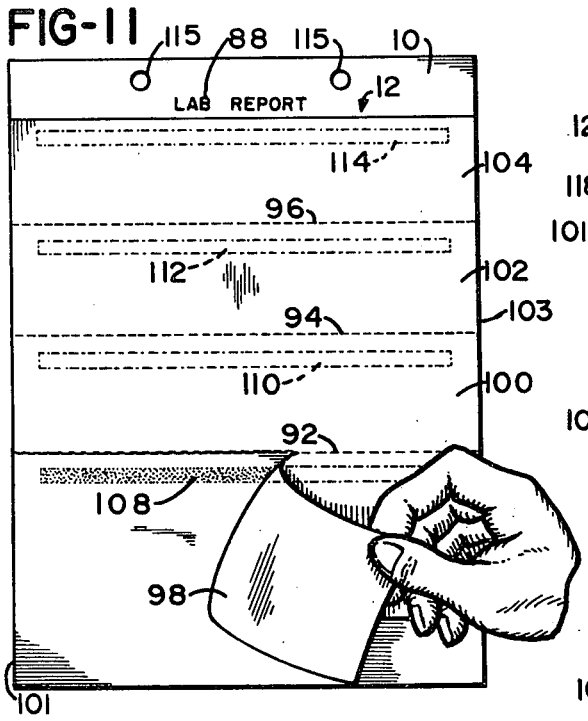

FIG. 10 is a perspective view of a series of auxiliary articles used in conjunction with the article of FIG. 9.

FIGS. 11, 12, 13, and 14 illustrate sequential steps in the use of the articles of FIGS. 9 and 10.

Figure 15:
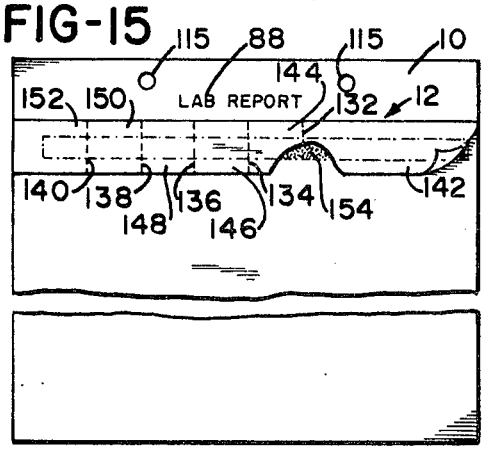

FIG. 15 is a modification of the second article produced from the multi-layer composition of FIG. 2.

Figure 16:
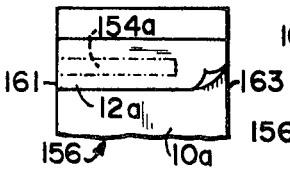

FIG. 16 is a portion of the auxiliary sheet for use in conjunction with the article of FIG. 15.

Figure 17:
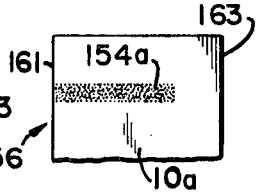

FIG. 17 is a view similar to FIG. 16, with the adhesive exposed.

Figure 18:
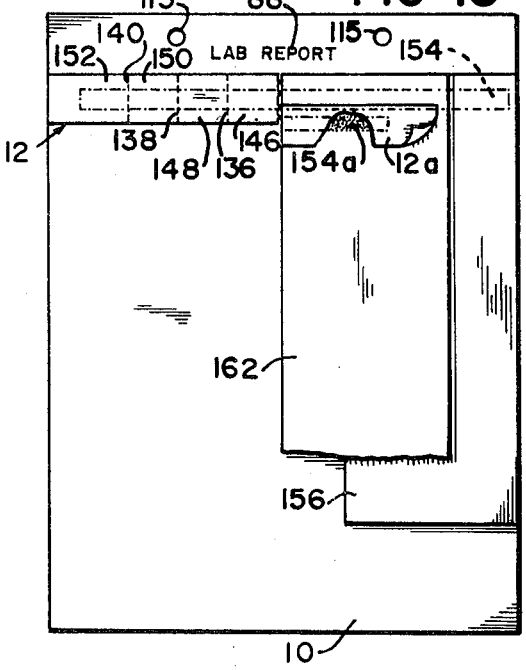
Figure 19:
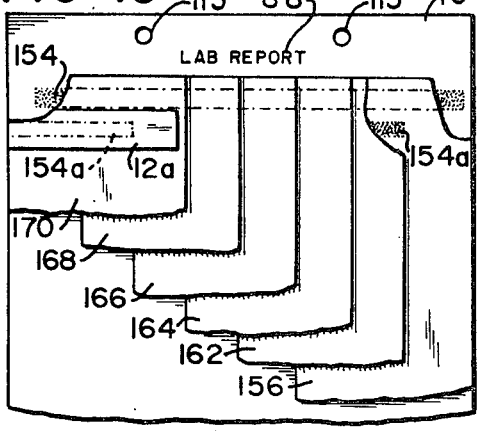

FIGS. 18 and 19 illustrate sequential steps in the use of the articles of FIGS. 15 and 16.

Figure 20:
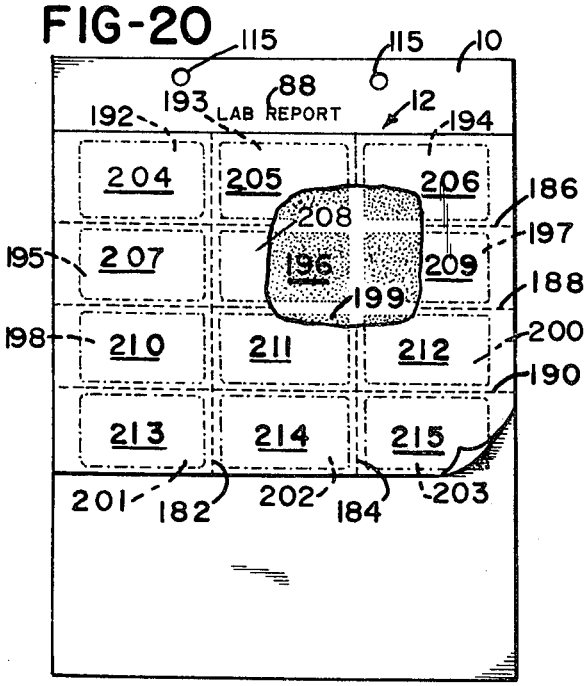

FIG. 20 is a further modification of a second article produced from the multi-layer composite of FIG. 2.

Figure 21:
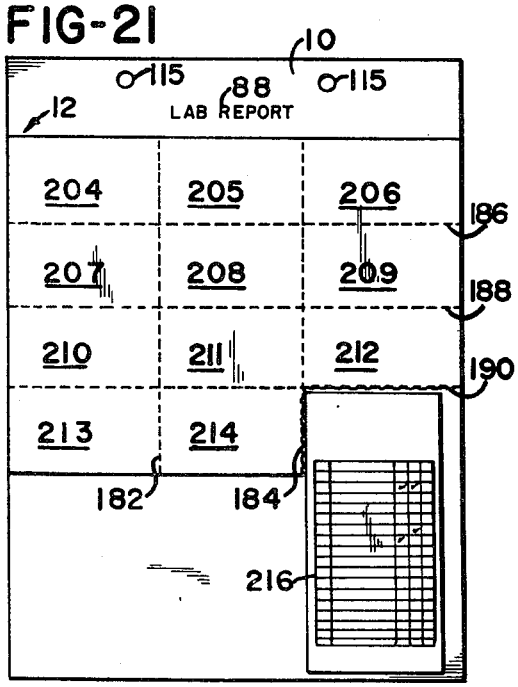

FIG. 21 is an illustration of the article of FIG. 20 with an auxiliary sheet attached thereto.

DETAILED DESCRIPTION

FIGS. 1, 2, *3a*, and *3b* diagrammatically illustrate the steps for producing the multi-layer composite and various articles of the present invention. FIGS. 4–8 illustrate a first exemplary article producible by the method of FIG. *3a*. FIGS. 9–21 illustrate several alterative embodiments of a second article producible by the method of FIG. *3b*.

The multi-layer composite of the present invention is shown generally as a continuous, composite web 33 (see FIG. 2) consisting of three material layers produced by the process of FIG. 2. The composite is adapted for subsequent processing to form each of the articles illustrated in FIGS. 8, 9, 15, 16, and 20. The web 33 consists generally of a web or layer of base material 10, a layer of pressure sensitive adhesive 11 selectively applied in a predetermined pattern to the base material, and a web or layer of release material 12 having a surface temporarily adherent to and readily strippable from the adhesive, the release material overlying that portion of the base material containing the adhesive. The adhesive 11 is of the type having natural affinity for the surface of the base material, and, once applied, becomes an integral part thereof. The release material 12 includes a surface that is temporarily adherent to, but readily strippable from the adhesive, to selectively expose desired portions thereof. While various processing steps have been illustrated in both FIGS. 1 and 2, the steps basic to formation of the web 33 are illustrated generally in FIG. 2 and include: (1) supplying an endless web of base material 10 at a fixed, substantially constant feed rate to an adhesive applicating mechanism 28 and (2) collating an endless web of release material 12 therewith, protecting the pressure sensitive adhesive, at 27. The collating station 27 generally includes mating the two endless webs, registering the webs in proper relationship at 30 and ensuring proper adherence of the release material to the adhesive at 32.

While these basic steps define the manufacturing process necessary to produce the composite web 33, various other steps preliminarily performed on the various composite components or subsequently performed on the final composite are desirable where particular articles are to be manufactured. However, all of the articles included herein are generated from the basic multi-layer composite including a base layer 10, a pressure sensitive adhesive layer 11 applied thereto and an overlying release layer 12.

In general, a variety of distinctly varying articles are producible from the web 33, including both articles containing only the base 10 and adhesive 11, and articles containing all three material layers. The first article utilizes the adhesive to form a closed pocket for concealing originally applied indicia to generate, for example, a lottery ticket. The second article contains at least one region of selectively exposable, pressure sensitive adhesive for attaching secondary articles thereto. FIG. *3a* includes the basic process steps for producing the first article, while FIG. *3b* includes the basic steps for producing the second. Exemplary articles are illustrated in FIGS. 4–21.

Starting with the composite web 33, the basic steps producing the first article include: (1) separating the release material from the adhesive 11 and base 10, at 40 of FIG. *3a*, and (2) folding the portion of the base sheet containing adhesive onto a portion not containing adhesive at 43, including both folding at 44 and securing at 46. Since the adhesive 11 will have an equal affinity for both portions of the base 10, the two portions are permanently sealed to form a two-ply format. The web is then separated into independent articles by bursting or cutting at 48 and 49.

To produce the second article, only one additional step subsequent to formation of the web 33 need be performed, as illustrated in FIG. *3b*. The web 33 is simply sliced into predetermined length sections as shown at 34, and stored at 36.

Thus, two distinct articles are obtainable from the composite web 33 by performing distinct auxiliary operations prior to collating or after the basic web has been produced.

In summary, the only required steps for producing the composite web 33 are illustrated in FIG. 2, viz: providing a continuous base 10; selectively applying a pressure sensitive adhesive 11 at 28; and collating a suitable release sheet 12 with the base sheet 10 and adhesive 11, at 27. Steps 14, 16, 18, 20, 22, 24, and 26 are auxiliary preliminary steps, generally optional, and are not inherent in the production of the multi-layer composition herein described Exemplary embodiments of a second article, wherein the release sheet 12 is included in the final product, are illustrated in FIGS. 9–21. The second articles are each produced by the basic processing steps of FIGS. 2 and 3*b*, i.e. supplying a properly prepared endless web of base material 10 at a relatively constant feed rate to an adhesive applying station 28, selectively applying pressure sensitive adhesive 11 in a predetermined pattern to the base, and collating an endless web of protective release material 12 with the base material and in overlying relationship with the adhesive at 27, to form the basic composite web 33. Then, as shown in FIG. 3*b*, the web designated 33*b* is cut or otherwise separated into predetermined length sections at cutter 34 to form individual articles as illustrated in FIGS. 9, 15, 16, and 20. Certain preliminary steps are generally performed on the base sheet 10 and/or the release sheet 12 prior to formation of the composite web. It should, of course, be understood that certain other process steps may be added or deleted, prior to or after the formation of web 33 without departing from the scope of the invention.

Generally, with respect to the articles of FIGS. 9–21, the base material 10 and the adhesive pattern 11 collectively define a mounting board or carrier sheet for selectively mounting auxiliary articles, whereas the release sheet 12 provides a protective cover for the adhesive until use. Therefore the preliminary steps are less complex than those required for the first article as illustrated in FIGS. 4–8. Referring to FIG. 1, the blank base sheet 10 is supplied with indicia 88, for example the words "LAB REPORT" at station 14. Then, where desired, run number on other identifying indicia may be added at 16. The other steps are not utilized and in the embodiments illustrated FIGS. 9–21.

It is desirable, although not necessary, to provide separate, independently removable, panels in the release sheet 12 in order that the patterned pressure sensitive adhesive 11 may be selectively exposed. This is provided at cross-perforation station 24 and/or longitudinal-perforation station 26 illustrated in FIG. 2. The embodiment of FIGS. 9–16 includes only longitudinal-perforations, while the embodiments of FIGS. 15–18 include only cross-perforations whereas the embodiment of FIGS. 20 and 21 utilizes both stations 24 and 26 to produce release sheet panels.

In the preferred embodiment of FIG. 9, the release sheet 12 substantially covers the entire base sheet 10, a small margin being left at the top and bottom. The steps in a method of producing this particular embodiment are illustrated in FIG. 3*b*. It should, of course, be understood that each modification of the second article is produced in generally the same manner. of the article because it is formed from a continuous web. When the composite web 33 is cut into predetermined length sections, here defined by boundaries 101 and 103, the release sheet 12 and base sheet 10 break at the same point.

The horizontal tear lines 92, 94, and 96 extend the width of the finished sheet 12 and are provided at station 26 of FIG. 2. These lines define separate panels 98, 100, 102, and 104 on the release sheet, extending the width thereof and completely covering the adhesive bands 108, 110, 112, and 114 supplied at station 28. As shown in FIG. 9 the tear lines 92, 94, and 96 are each slightly above the respective adhesive band, permitting selective exposure of any of one or several of the bands at any desired time.

The adhesive bands each extend substantially the width of the finished article, a small margin remaining at each end of the bands, being generated by a periodically interrupted continuous band applied at station 28. After the adhesive 11, and the properly prepared release sheet 12 have been applied to base sheet 10 to form the composite web, the web is cut into predetermined length sections at cutting station 34, and stacked or otherwise stored at 36. It may be desirable to punch or otherwise provide mounting holes 115 at this time.

Figure 13:
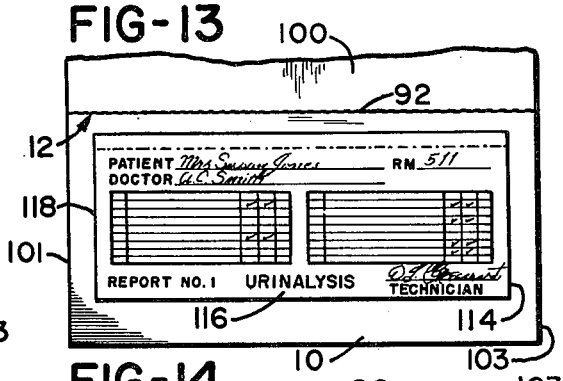
Figure 12:
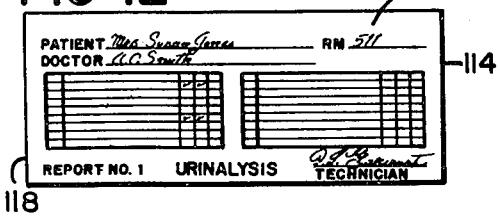

The embodiment of FIG. 9 is particularly well suited for a medical environment wherein a series of lab reports, completed in different locations, may be assembled for easy reference. Generally, a series of lab reports, for example "REPORT NO. 1" designated 116 in FIG. 10, is maintained at a particular lab reporting station. At the conclusion of testing the lab report is completed and removed from the series along perforation line 118 and is ready for placement on the carrier sheet provided by the base material 10 and adhesive 11. The user then removes the first panel 104 of the release sheet by tearing along line 96, exposing the first adhesive band 114. The article 116, as illustrated in FIG. 12 may then be placed over the adhesive band and attached to the base sheet as illustrated in FIG. 13.

By utilizing the patterned adhesive process indicated at station 28 of FIG. 2, it is possible to provide an adhesive band which is substantially the same length as the report 116. Therefore, none of the adhesive will extend beyond the margins 114 and 118 of the report, thus providing a suitable attachment and accumulation form for the reports without having exposed adhesive, thereby preventing the final report from accidentally adhering to another item, for example, when filing.

Figure 14:
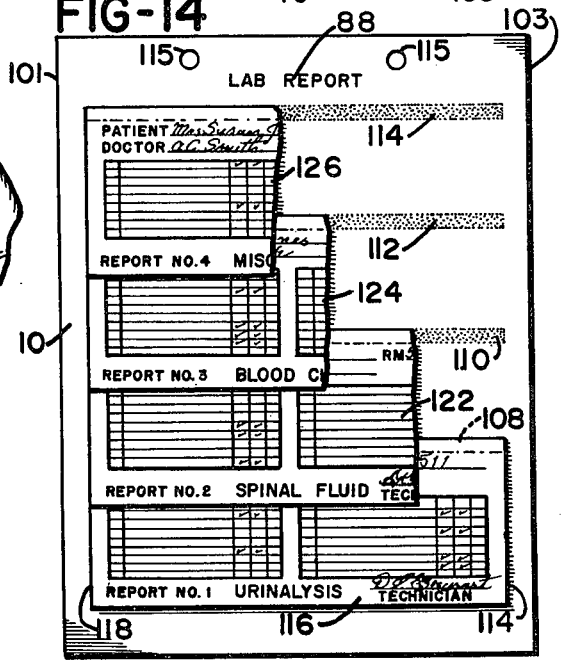

As a patient progresses from lab station to lab station other reports may be added to the carrier sheet simply by removing the subsequent panels 98, 100, 102, and 104 therefrom and exposing, in sequence, adhesive bands 108, 110, 112 and 114. The final form of the lab report carrier sheet with all the reports attached thereto is illustrated in FIG. 14, wherein each of the lab reports 116, 122, 124, and 126 are attached to respective adhesive bands 108, 110, 112, and 114 in echelon relationship. Thus, each report may be lifted to completely expose the report directly beneath it, conserving filing space while providing a full report from each lab station. As shown, the adhesive bands 108, 110, 112, and 114 do not extend beyond the full length of each report, thus ensuring that the lab report will not later become accidentally attached to external, independent articles. In the event all of the lab reports are not used, any panel of the release sheet 12 may be retained, thereby covering the adhesive, preserving it for future use, and protecting it from accidental attachment.

An alternative embodiment of a lab report is illustrated in FIGS. 15–19. Here, a single adhesive band 154 is supplied to extends the full width of the lab report. However, rather than horizontal tear lines defining panels as illustrated in the embodiment of FIG. 9 vertical tear lines 132, 134, 136, 138 and 140 which extend the width of the release sheet are provided for separating the single adhesive band into a series of individual regions 142, 144, 146, 148, 150 and 152. Thus, to expose the first portion of the adhesive band 154, the first panel of the release sheet, i.e. panel 142, is removed. Subsequent portions of the adhesive band are exposed in the same manner.

When utilizing the carrier sheet of FIG. 15, it is desirable to utilize the lab report form 156 illustrated in FIGS. 16–18. The lab report form is similar to the carrier sheet of FIG. 15 and is produced by the same process, on a smaller scale. A continuous release sheet 12*a* covers the single band of adhesive 154*a* contained on base 10*a*. The release sheet, being readily strippable, is removed when the lab report 156 is to be attached to the carrier sheet of FIG. 17. The adhesive band 154*a* does not extend the full width of the report, but (see FIG. 10) starts at margin 161 and continues partially across the width of the report to a region near the second margin 163. The adhesive is completely covered by the release sheet 12*a* until such time as a second lab report 162 is secured thereto, see FIG. 18. When the lab reports are attached to the carrier sheet, the first release sheet panel 142 is removed and the first lab report 156 is attached thereto.

It will be noted that the attachment of the lab report 156 completely covers the exposed portion of the adhesive band 154 thus ensuring that the band will not accidentally adhere to foreign articles.

When the second report 162 is attached to the base or carrier sheet, the release sheet 12*a* is removed from report 156 for exposing adhesive band 154*a*, and likewise panel 144 is likewise removed from the carrier sheet for exposing a portion of adhesive band 154. Report 162 is then attached directly to report 156 and the carrier sheet of FIG. 15, as illustrated in FIG. 18. Subsequent reports 164, 166, 168 and 170 may be applied in a similar manner, the final form being illustrated in FIG. 19.

The release sheet 12*a* is not removed from the final lab report 170, the adhesive band 154*a* thereof not being utilized. This ensures that the carrier sheet with individual reports assembled thereon will not accidentally become attached to foreign articles during filing.

Another embodiment of the lab report carrier sheet is illustrated in FIGS. 20 and 21. The patterned adhesive is applied in a plurality of independent regions or patches 192–203 at station 28 of FIG. 2. In this embodiment, the release sheet 12 includes both vertical tear lines 182 and 184 applied at 24, and horizontal tear lines 186, 188, and 190 applied at 26, to provide twelve independent panels 204–215, each panel covering one of the adhesive patches 192–203. FIG. 21 illustrates the attachment of a typical lab report form 216 to one of the panels of the carrier sheet of FIG. 20. Panel 215 of the release sheet is removed from the carrier sheet along lines 184 and 190, exposing adhesive patch 203. As can be seen, the adhesive patch 203 does not extend to the edge of the area exposed when panel 215 is removed from the release sheet 12. Thus, when the lab report 216 is attached to the carrier sheet none of the adhesive will be exposed. As in previous embodiments, subsequent panels may be removed, exposing in sequence the adhesive patches whereby a plurality of lab reports may be mounted on the carrier sheet in echelon fashion.

As can be seen, by utilizing the various embodiments of the carrier sheet illustrated in FIGS. 9–21, any variety of report forms can be generated for use with a variety of auxiliary articles. By utilizing the various accumulation techniques herein illustrated, the number of lab reports may vary from four to twelve while requiring little additional space in a filing system.

Thus, it can be seen that a variety of articles may be produced from the composite web of the present invention. While the embodiments here described are limited to lab report base or carrier sheets, it should be understood that any of a variety of other articles may be produced from the composite web without departing from the invention.

What is claimed is:

1. A medical information form comprising a base or carrier sheet and one or more reports which are selectively secured thereto, said base or carrier sheet having a particular pattern of pressure sensitive adhesive on one surface thereof, which subdivides said surface into areas which are free of adhesive, and wherein said pattern comprises an elongate, transversely extending strip co-extensive with the width of the base or carrier sheet, and a release sheet secured to, carried by, and overlying the said base or carrier sheet and the adhesively coated surface thereof, said release sheet longitudinally subdivided into a plurality of interconnected, independently removable sub-panels each of which overlies an adhesive strip and an area of the base or carrier sheet which is to be occupied by a single report upon removal of a sub-panel whereby to secure one report to the particular adhesive pattern which is exposed incident to the removal of a sub-panel of the release sheet, and wherein each report is not only secured to the base or carrier sheet but also to a portion of an adjacent report when mounted on the information form, said portion of the adjacent report including a coating of pressure sensitive adhesive and a strip of removable release sheet secured to, carried by, and concealing said adhesive coating.

* * * * *